US005575315A

United States Patent [19]

Wengert

[11] Patent Number: 5,575,315

[45] Date of Patent: Nov. 19, 1996

[54] DEVICE AND METHOD FOR FILLING A SANDBAG

[76] Inventor: James A. Wengert, 4590 Muir Ridge Ct., Batavia, Ohio 45103

[21] Appl. No.: 314,061

[22] Filed: Sep. 28, 1994

[51] Int. Cl.[6] ..... B65B 67/00

[52] U.S. Cl. ..... 141/109; 141/10; 141/114; 141/108; 141/314; 141/391; 53/255; 53/390; 294/53.5; 294/55

[58] Field of Search ..... 141/10, 108, 109, 141/114, 314, 390, 391; 53/255, 390, 570; 294/53.5, 55; 15/257.1, 257.3

[56] References Cited

U.S. PATENT DOCUMENTS

| | | | |
|---|---|---|---|
| 593,299 | 11/1897 | Jeklin | 15/257.3 |
| 744,338 | 11/1903 | Hall | 141/108 |
| 760,391 | 5/1904 | Fuller | 15/257.3 |
| 1,128,183 | 2/1915 | Petrie | 141/108 |
| 1,234,057 | 7/1917 | McIntyre | 141/314 |
| 2,508,699 | 5/1950 | Welsh | 141/108 |
| 3,916,962 | 11/1975 | Stolt | 141/108 |
| 4,149,745 | 4/1979 | Willis | 294/55 |
| 5,014,943 | 5/1991 | Nelson et al. | 141/391 X |
| 5,107,666 | 4/1992 | Rahtican | 141/391 X |
| 5,395,147 | 3/1995 | Brown et al. | 294/55 |

FOREIGN PATENT DOCUMENTS

| | | | |
|---|---|---|---|
| 0162168 | 1/1949 | Austria | 141/108 |
| 0026130 | 10/1953 | Finland | 141/314 |

*Primary Examiner*—J. Casimer Jacyna
*Attorney, Agent, or Firm*—Wood, Herron & Evans, P.L.L.

[57] ABSTRACT

This invention is directed to a device and method for enabling a person to fill a sandbag quickly and efficiently without the assistance of another person.

The inventive sandbag shovel preferably includes a scoop for scooping up the sand, a chute flexibly connected to the scoop for directing sand from the scoop into a sandbag, a sandbag gripper mounted to the chute for releasable connection to the mouth of a sandbag to maintain the sandbag mouth in sand-receiving relationship to the chute, and a pair of handles connected to the scoop.

17 Claims, 2 Drawing Sheets

DEVICE AND METHOD FOR FILLING A SANDBAG

BACKGROUND OF THE INVENTION

1. Field of the Invention

This invention relates to shoveling materials into a container, and more particularly, to a device and method for filling a sandbag.

2. Description of the Related Art

Sandbags have been used for centuries as weapons to be dropped upon an approaching enemy, as ballast for balloons, and as fortifications both in wartime and natural disasters.

In recent times, sandbags have been used most heavily as dams or dikes to halt the flow of approaching water. Several regions throughout the country have a long standing history of flood-related disasters due to violent coastal storms, overflowing river levels and even storm water runoff from heavy rainfalls. With each of these disasters, hundreds and even thousands of people had to be mobilized quickly in an attempt to save lives and property from the rapidly approaching flood waters. This was done essentially by evacuating people as needed and erecting sandbag dams as quickly as possible. Unfortunately, traditional technology severely limits the rate at which sandbags may be filled and protective dams constructed.

Generally, sandbag filling is done in one of two ways. In the typical two person method, one person holds a sandbag open while a second person uses a traditional shovel to shovel sand into the mouth of the bag. In a one person method, a single person attempts to keep the sandbag open with one hand while simultaneously shoveling sand into the bag with the other hand using a standard shovel. Both of these methods have severe limitations. The traditional one person method is inherently slow because the person must attempt to keep the sandbag open while simultaneously maneuvering a shovel full of sand into the opening of the bag. And while the two person method allows a single bag to be filled more quickly, the process is not two times as fast, and therefore any gain in speed is hindered by the fact that an additional person is required.

The traditional equipment and methods present serious problems when flood waters are rapidly approaching because what is needed is a great deal of speed with often severely limited human resources. Currently, there is no effective device or method for achieving high speeds with limited human capital, and therefore it is highly desirable to have some sort of device which is adapted to increase the speed with which a limited number of people may fill sandbags. Another difficulty with the current tools and methods for filling sandbags is that the sand must be carried from a sand pile over to the mouth of the sandbag. This transportation step requires additional time and may even lead to a loss of sand due to spillage.

Therefore, it is desirable to have an apparatus which allows a single user to efficiently keep the mouth of the sandbag open while simultaneously filling the sandbag. It is also desirable for the user to be able to maintain the mouth of the sandbag close to the shoveling tool as the user moves the tool into and around a particular sand pile.

SUMMARY OF THE INVENTION

This invention is directed to a device and method for moving material, such as sand, dirt, rock, or gravel into a container such as a sandbag or other container made of a flexible material. "Sand" refers to any granular or particulate material with grains of large and/or small size, while "flexible material" refers to a material having no fixed shape or configuration, for example, canvas, burlap, reinforced plastic and the like. The device is a shovel which includes a scoop for scooping up the material, a chute flexibly connected to the scoop for directing material from the scoop into a container, a connector interconnecting the scoop and chute, and a container gripper mounted to the chute and/or scoop for releasable connection to the mouth of a container to maintain the container mouth in material-receiving relationship to the chute.

More particularly, the scoop includes a head region, a base region, and two side edge regions, while the chute includes a material entry end and a material exit end, with the scoop and chute forming a shovel body. In addition, the connector interconnects the scoop and chute so as to locate the base region of the scoop adjacent to the material entry end of the chute throughout a range of relative angular movement between the scoop and chute.

Preferably, the connector is a hinge or pair of hinges made of leather, plastic, rubber or metal. The container gripper may include an extension arm or pair of extension arms extending outwardly in opposite directions from the shovel body and adapted to shape the mouth of the container. Furthermore, the gripper and extension arms typically include catches such as barbs, or the like, for releasably engaging the container.

In addition, the shovel may include a handle or pair of handles connected to the shovel body and extending outwardly therefrom. Preferably, a first handle is connected to one of the two side edge regions of the scoop and a second handle is connected to the other of the two side edge regions.

The invention also includes a shovel system comprising the shovel discussed above in combination with a container, such as a sandbag or the like, and a method of filling a sandbag.

In its simplest form, the inventive sandbag shovel may include: a scoop having a head region, a base region, and two side edge regions; a chute for directing sand from the scoop into a sandbag; and a container gripper mounted to the chute. The chute has a sand entry end connected to the base region of the scoop for receiving the sand from the scoop, and the chute further includes a sand exit end for delivering sand into the sandbag. Alternatively, the basic shovel may include: a scoop having a head region, a base region, and two side edge regions; a chute for directing sand from the scoop into a sandbag, the scoop and chute forming a shovel body; and a first and second handle connected to the shovel body. The chute has a sand entry end connected to the base region of the scoop, as well as a sand exit end for delivering sand into the sandbag.

The device and method of this invention offer several benefits and advantages. For example, the container gripper allows a single user to keep the mouth of the sandbag open while simultaneously filling the sandbag, thereby improving efficiency. Also, because the shovel design keeps the mouth of the sandbag adjacent to the scoop, the user does not have to carry the sand from a sand pile over to the sandbag. This proximity increases the speed with which the operator may fill a sandbag and also reduces the amount of spilled or wasted sand. These and other benefits and advantages allow a single user to fill sandbags quickly and efficiently without the assistance of an additional person.

DETAILED DESCRIPTION OF THE PREFERRED EMBODIMENT

Figure 1:
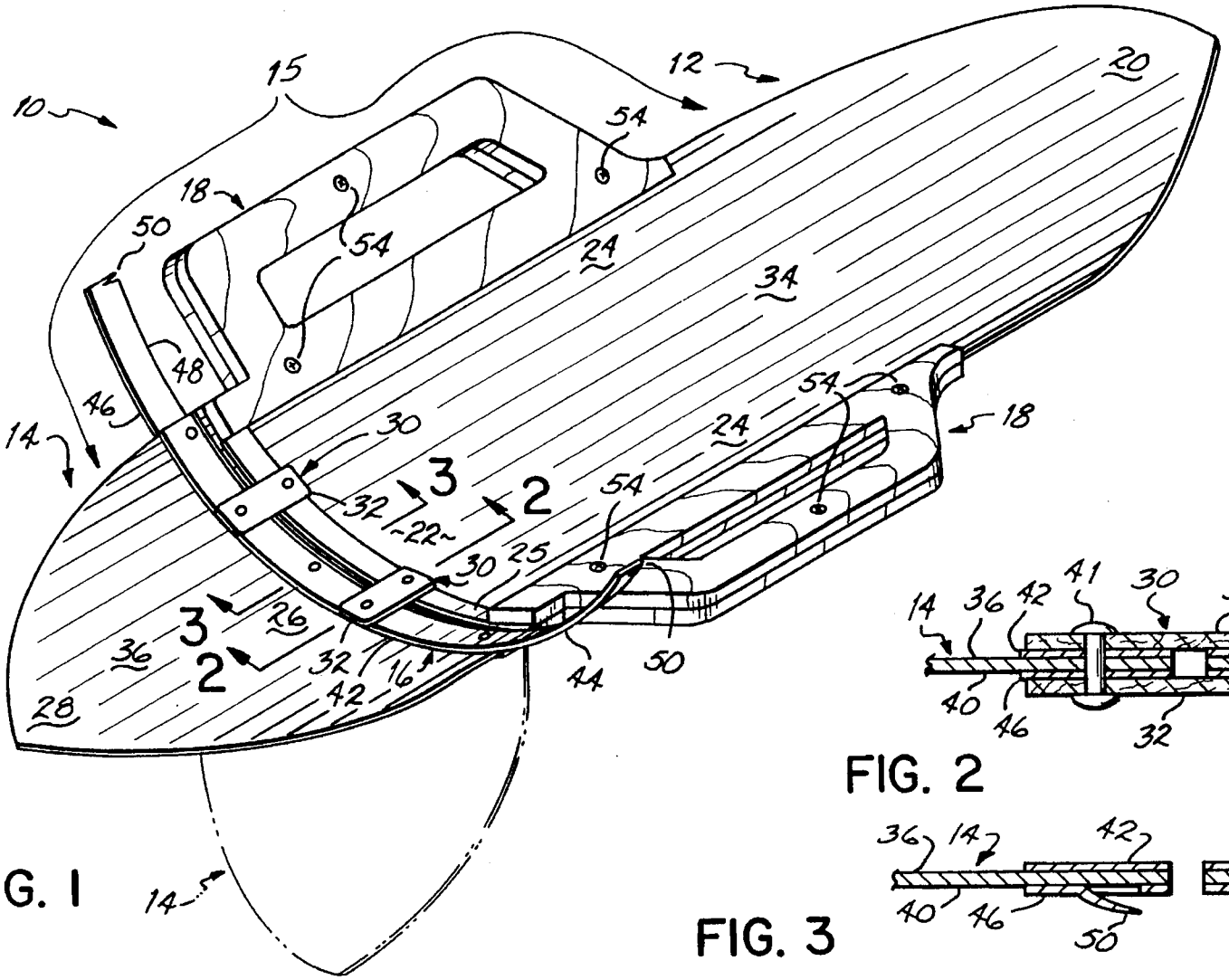
FIG. 1 is a perspective view of the preferred embodiment of the inventive sandbag shovel.

The preferred embodiment according to the principles of the invention is shown in FIG. 1. The shovel 10 includes a scoop 12 for scooping up the sand, a chute 14 flexibly connected to the scoop 12 for directing sand from the scoop 12 into a sandbag, a sandbag gripper 16 mounted to the chute 14 for releasable connection to the mouth of a sandbag to maintain the sandbag mouth in sand-receiving relationship to the chute 14, and a pair of handles 18 connected to the scoop 12.

The scoop 12 and chute 14 form the shovel body 15. The scoop 12 has a head region 20, a base region 22 and two side edge regions 24. The lowest portion of the base region 22 is sandwiched between two pieces of metal strapping 25, which run the width of the scoop 12 and conform to the scoop's curvature. Each piece of strapping 25 has a thickness of about 1/32" and provides additional strength and support for the hinges 30 or other connector(s) interconnecting the scoop 12 and chute 14. The chute 14 includes a sand entry end 26 and sand exit end 28, with the sand entry end 26 being connected to the base 22 of the scoop 12 by two sets of hinges 30.

Figure 2:
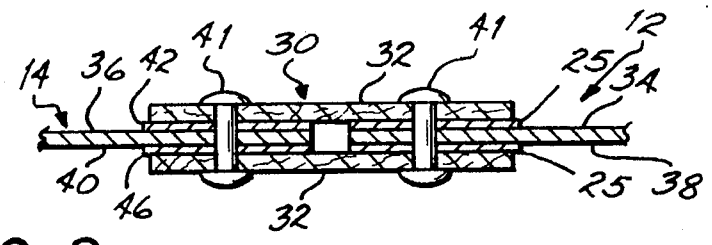
FIG. 2 is a cross-sectional view of FIG. 1 taken along line 2—2, illustrating a flexible hinge.

In the preferred embodiment, each set of hinges 30 includes a pair of leather pieces 32 connected to the scoop 12 and chute 14, with one piece connected to the top surface of the scoop 15 and chute 34, 36 and the other piece connected to the bottom surface of the scoop and chute 38, 40 as shown in FIG. 2. Each leather piece has a thickness of about 1/8". Although the hinges 30 preferably are made of leather, other connector materials may be used as well, such as, for example, plastic, rubber or metal. The hinges 30 preferably are connected to the scoop 12 and chute 14 using a bolt, 1/4 inch nut, lock washer and washer (not shown). However, any secure fastening means 41 may be used, such as rivets (shown), conventional fasteners, adhesive or the like. If desired, the number of hinges or connectors may be varied. For example, a wide single hinge or many small narrow hinges may be used. Also, the hinges may be designed to allow the user to set or lock the relative angle between the scoop and chute.

In alternate embodiments, the scoop may be rigidly connected to the chute by welding or the like, or the scoop and chute may be formed of a single piece in which case no connector is needed to hold the two sections together. In such instances, the top surfaces of the scoop and chute typically are linearly aligned so that the sand or other material follows a straight path as it moves from scoop to chute and into the sandbag. However, if desired, the scoop and chute may be formed so that a nonlinear fixed angle exists between the top surfaces of the scoop and chute.

In the preferred embodiment, the sandbag gripper 16 is formed using two sections of metal strapping 42, 46 (each section being approximately 1/32" in thickness). One section 42 is positioned across the top surface 36 of the sand entry end 26 and includes a single extension arm 44 extending to the right (as shown in FIG. 1) or to the left. The other section 46 is positioned across the bottom surface 40 of the sand entry end 26 and includes a single extension arm 48 extending to the left (as shown in FIG. 1) or to the right. These two sections 42, 46 conform generally to the curvature of the chute 14 and are attached to the chute 14 using a nut and bolt assembly similar to that used for connecting the hinges; however, any secure fastening means may be used.

Each extension arm 44, 48 extends up and out from the chute 14 and includes a catch 50 near the end of the arm for releasably engaging a portion of the mouth of the sandbag. Also, the sandbag gripper section 46 positioned across the bottom surface 40 of the sand entry end 26 includes an additional catch 50 located centrally along the section and projecting out and up from the bottom surface 40 of the chute 14 as shown in FIG. 3, providing another connection point for releasably connecting the sandbag to the chute.

Figure 3:
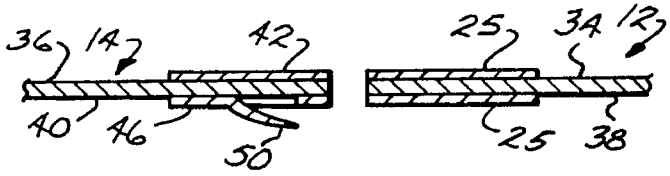
FIG. 3 is a cross-sectional view taken along line 3—3 of FIG. 1, illustrating a barb used to grasp a sandbag.

Preferably, these catches 50 are notches or barbs as shown in FIGS. 1 and 3. However, the sandbag gripper may be designed with other catches, such as hooks or the like, or without any catch at all, in which case the sandbag remains releasably connected to the sandbag gripper based simply upon the mechanical support of the extension arms, If desired, a single sandbag gripper section may be used to form both right and left extension arms; or for added strength, the top and bottom gripper sections each may have two extension arms, in which case the two right arms may be bonded to one another and the two left arms may be similarly bonded.

In other embodiments, the sandbag gripper may be located along the base region of the scoop or along both the scoop base region and chute sand entry end, with extension arms projecting out and up from the shovel body, following the general curvature of the chute or scoop. Alternatively, an extension arm or arms may project directly up and out from the interior of the scoop or chute top surface. Although the sand will contact such central extension arms, they will still serve to support the sandbag. Furthermore, the sandbag remains releasably connected to the shovel with any of these configurations. If desired, the sandbag shovel also may be made without the sandbag gripper. In such devices, the user may have to carry sand over to the sandbag because the bag is not connected to the shovel.

In the preferred embodiment, the shovel 10 includes a handle 18 attached to each of the side edge regions 24 of the scoop 12, as shown in FIG. 1. The handles 18 preferably are positioned along the lower half of the scoop side edges 24 as shown in FIG. 1, in order to give the user maximum control in shoveling sand onto the scoop 12 and then in elevating the angle of the scoop 12 to enable the sand to flow into the sandbag. The handles 18 may be made of any rigid material, for example, wood, plastic, or metal, and if wood is used, oak is preferred because of its hardness and durability. The handles 18 may be bonded or connected to the chute using any standard fastener, such as screws, bolts, rivets, adhesives, and the like, and in the preferred embodiment, screws 54 are used to attach the oak handles 18 to the scoop 12.

Different handle configurations also may be used. For example, the handles may be positioned further up or down along the shovel body, or a central, single handle may be elevated above the top surface of the scoop and chute and connected to the shovel body by a stem or stems. The shovel also may be designed without any formal handles, in which case the operator may grasp the side edge regions of the scoop.

Figure 4:
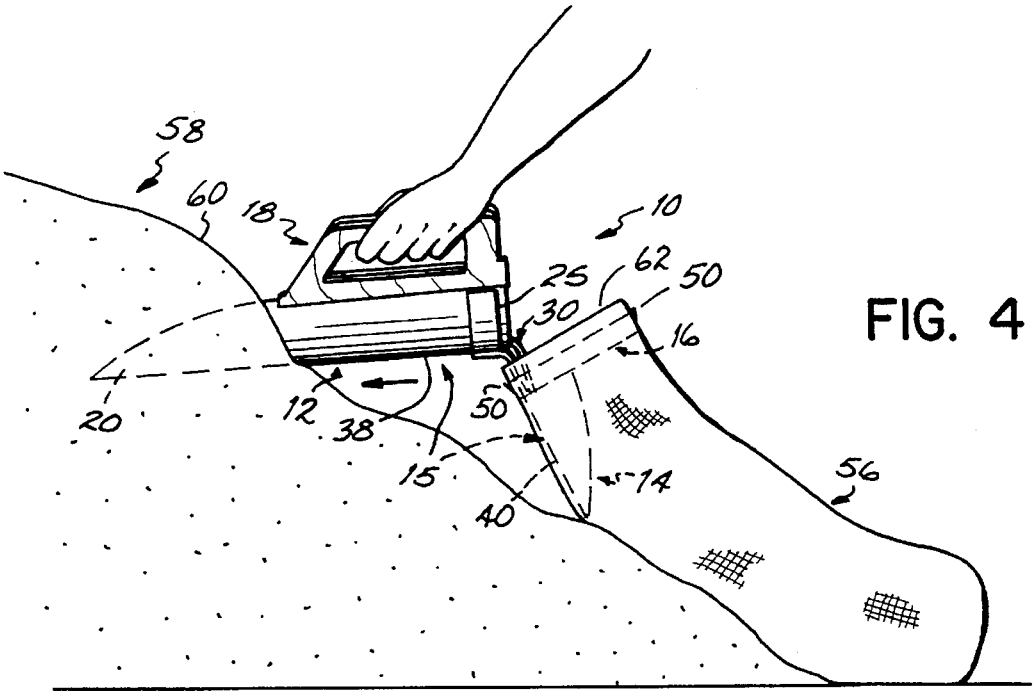
FIG. 4 is a schematic perspective view showing a person shoveling sand onto the scoop of the inventive shovel.
Figure 5:
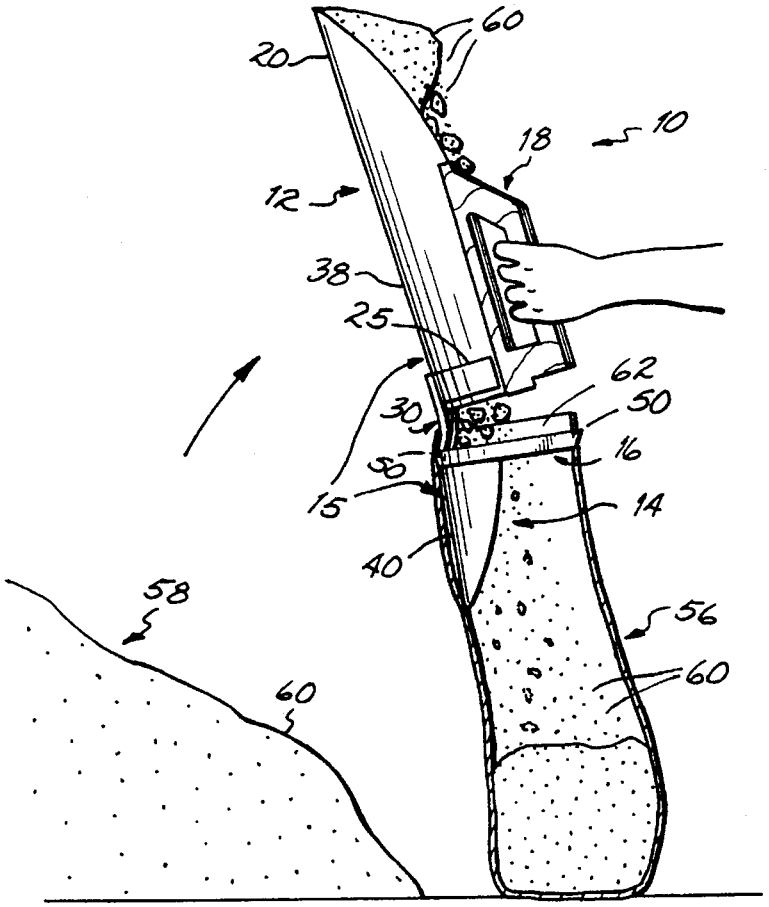
FIG. 5 is a schematic perspective view showing a user elevating the head region of the scoop above its base region such that the sand moves into the sandbag.

In use, the sandbag shovel allows a single person to fill sandbags quickly and easily. The user simply takes a sandbag and draws the mouth of the bag up around the chute and extension arms of the sandbag gripper. The user then releasably connects the mouth of the sandbag to the sandbag gripper, either by easily pushing the barbs, or other similar catches through the sandbag material, or folding a portion of the mouth of the sandbag over and around the extension arms. With the bag 56 now connected to the shovel 10, the operator may begin to fill the sandbag 56 as shown in FIG. 4. The operator pushes the head region 20 of the scoop 12 into a sand pile 58 to load the scoop 12 with sand 60. Then the person elevates the head region 20 of the scoop 12, enabling the sand 60 to move down the top surface 34 of the scoop 12 and directly into the mouth 62 of the sandbag 56 as shown in FIG. 5. Once the bag is filled to the desired level, the user simply removes the mouth of the bag from the gripper.

Because the chute is flexibly connected to the scoop in the preferred embodiment, the chute puts little stress and strain on the sandbag as the user loads the scoop with sand. The chute and gripper serve to hold the mouth of the sandbag in an open position. The sandbag gripper also serves to keep the mouth of the sandbag adjacent to the base region of the scoop, so that substantially all of the sand from the scoop moves into the sandbag. In addition, the chute helps guide the sand into the lower region of the sandbag and reduces some of the stress on the upper portion of the bag as the sand enters in through the bag mouth.

Because the bag remains releasably connected to the sandbag shovel throughout the filling process, the user may continue to shovel sand into the bag until the desired fill level is reached. In addition, because the sandbag remains flexibly connected to the shovel, the user may move to a different part of the sand pile or to an entirely different sand pile to complete the filling of the bag. Wherever the scoop may roam, the bag is sure to follow.

These various features and advantages of the sandbag shovel ultimately allow the user to fill sandbags quickly and efficiently without the need to constantly reshape the mouth of the sandbag or carry the sand several feet from the sand pile to the mouth of the bag. Furthermore, the inventive sandbag shovel enables the operator to fill sandbags without the assistance of another person, and with flood waters rapidly approaching, the benefit of improved efficiency is vital.

While the invention has been described in detail with respect to specific embodiments, it will be appreciated that those skilled in the art may readily conceive of alterations to, variations of, and equivalents to those embodiments. Accordingly, the invention is represented by the appended claims and any equivalents thereto.

What is claimed is:

1. A shovel for moving material into a container, comprising:

a continuously curved scoop having a head region, a base region and two side edge regions located between said head and base regions;

a non-tubular chute to direct material from said scoop into a container, said chute having a material entry end adjacent to said base region of said scoop and a material exit end, said scoop and chute forming a shovel body;

a connector interconnecting said scoop and said chute to locate said base region of said scoop adjacent said material entry end of said chute throughout a range of relative angular movement therebetween; and a container gripper mounted to said shovel body and releasably connectable to the mouth of a container to maintain the container mouth in material-receiving relationship to said exit end of said chute when releasably connected thereto.

2. The shovel of claim 1 wherein said connector is a hinge interconnecting said base region of said scoop and said material entry end of said chute.

3. The shovel of claim 2 wherein said hinge is made of a material selected from the group consisting of leather, plastic, rubber and metal.

4. The shovel of claim 1 wherein said container gripper includes an extension arm adapted to shape said mouth of said container in an open condition.

5. The shovel of claim 4 wherein said extension arm includes a catch for engaging said container mouth.

6. The shovel of claim 1 further including a first handle connected to said scoop.

7. The shovel of claim 6 further comprising a second handle connected to said scoop.

8. The shovel of claim 7 wherein said first handle is connected to one of said two side edge regions of said scoop and said second handle is connected to the other of said two side edge regions.

9. A shovel system comprising:

(i) a shovel for moving material into a container, comprising:

a continuously curved scoop having a head region, a base region and two side edge regions located between said head and base regions;

a non-tubular chute to direct material from said scoop into a container, said chute having a material entry end adjacent to said base region of said scoop and a material exit end, said scoop and chute forming a shovel body;

a connector interconnecting said scoop and said chute to locate said base region of said scoop adjacent said material entry end of said chute throughout a range of relative angular movement therebetween; and a container gripper mounted to said shovel body and releasably connectable to the mouth of a container to maintain the container mouth in material-receiving relationship to said exit end of said chute when releasably connected thereto; and (ii) a container.

10. A shovel for filling a sandbag fabricated of flexible material, comprising:

a scoop having a head region, a base region and two side edge regions;

a non-tubular chute for directing sand from said scoop into a sandbag, said chute having a sand entry end adjacent to said base region of said scoop and a sand exit end, said scoop and said chute forming a shovel body;

a connector interconnecting said scoop and said chute to locate said base region of said scoop adjacent said material entry end of said chute throughout a range of relative angular movement therebetween;

a sandbag gripper mounted to said shovel body and releasably connectable to the mouth of a sandbag to maintain the sandbag mouth in sand-receiving relationship to said exit end of said chute when releasably connected thereto;

a first handle connected to one of said two side edge regions of said scoop; and a second handle connected to the other of said two side edge regions of said scoop.

11. A sandbag shovel system comprising:

(i) a shovel for filling a sandbag fabricated of flexible material, comprising:

a scoop having a head region, a base region and two side edge regions;

a non-tubular chute for directing sand from said scoop into a sandbag, said chute having a sand entry end adjacent to said base region of said scoop and a sand exit end, said scoop and chute forming a shovel body;

a connector interconnecting said scoop and said chute to locate said base region of said scoop adjacent said material entry end of said chute throughout a range of relative angular movement therebetween;

a sandbag gripper mounted to said shovel body and releasably connectable to the mouth of a sandbag to maintain the sandbag mouth in sand-receiving relationship to said exit end of said chute when releasably connected thereto;

a first handle connected to one of said two side edge regions of said scoop; and a second handle connected to the other of said two side edge regions of said scoop; and (ii) a flexible sandbag.

12. A method of filling a sandbag fabricated of flexible material, comprising the steps of:

providing a shovel having:

(i) a scoop having a head region, a base region and two side edge regions;

(ii) a non-tubular chute adjacent to said scoop for directing sand from said scoop into a sandbag, said scoop and chute forming a shovel body;

(iii) a connector interconnecting said scoop and said chute to locate said scoop adjacent said chute; and (iv) a sandbag gripper mounted to said shovel body and releasably connectable to the mouth of the sandbag to maintain the sandbag mouth in sand-receiving relationship to said chute when releasably connected thereto;

providing a sandbag having a mouth;

inserting said chute into the mouth of the sandbag;

releasably connecting said sandbag gripper to the mouth of the sandbag to maintain the container mouth in sand-receiving relationship to said chute;

scooping sand from a sand pile onto said scoop;

elevating said head region of said scoop above its base region such that the sand moves from said scoop through the sandbag mouth and into the sandbag via said chute; and releasing the sandbag from said sandbag gripper.

13. A shovel for filling a sandbag, comprising:

a continuously curved scoop having a head region, a base region and two side edge regions;

a chute for directing sand from said scoop into a sandbag, said chute being nontubular and having a sand entry end adjacent to said base region of said scoop for receiving sand from said scoop, said chute further having a sand exit end for delivering sand into the sandbag, said scoop and chute forming a shovel body; and a container gripper mounted to said shovel body, non-movable with respect to said chute, and releasably connectable to the mouth of the sandbag to maintain the mouth in sand-receiving relationship to said sand exit end of said chute when releasably connected thereto.

14. The shovel of claim 13 further including a first handle connected to said shovel body.

15. The shovel of claim 14 further comprising a second handle connected to said shovel body.

16. The shovel of claim 15 wherein said first handle is connected to one of said two side edge regions of said scoop and said second handle is connected to the other of said two side edge regions.

17. A shovel for filling a sandbag, comprising:

a scoop having a head region, a base region and two side edge regions;

a non-tubular chute for directing sand from said scoop into a sandbag, said chute having a sand entry end adjacent to said base region of said scoop for receiving sand from said scoop, said chute further having a sand exit end for delivering sand into the sandbag, said scoop and chute forming a shovel body; and a first and second handle, said first handle being connected to one of said two side edge regions of said scoop but not to the other of said two side edge regions, said second handle being connected to said other of said two side edge regions but not to said one of said two side regions.

* * * * *